US009995563B2

(12) United States Patent
Redeker et al.

(10) Patent No.: US 9,995,563 B2
(45) Date of Patent: Jun. 12, 2018

(54) CARTRIDGE WITH SAFETY FUSE IN THE DRIVE SYSTEM, AND METHOD FOR PRODUCING IT

(71) Applicant: RHEINMETALL WAFFE MUNITION GMBH, Unterluess (DE)

(72) Inventors: Hendrik Redeker, Grosshansdorf (DE); Willi Luebbers, Kuddewoerde (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 50 days.

(21) Appl. No.: 15/337,307

(22) Filed: Oct. 28, 2016

(65) Prior Publication Data

US 2017/0299361 A1 Oct. 19, 2017

Related U.S. Application Data

(63) Continuation of application No. PCT/EP2015/058616, filed on Apr. 21, 2015.

(30) Foreign Application Priority Data

Apr. 28, 2014 (DE) ..... 10 2014 005 997

(51) Int. Cl.
*F42B 39/20* (2006.01)
*F42B 33/00* (2006.01)
(Continued)

(52) U.S. Cl.
CPC ..... *F42B 39/20* (2013.01); *F42B 5/02* (2013.01); *F42B 33/001* (2013.01); *F42C 19/083* (2013.01)

(58) Field of Classification Search
CPC ..... F42B 3/103; F42B 3/24; F42B 30/003; F42B 33/04; F42B 33/001; F42B 39/14; F42B 39/20; F42D 5/04
See application file for complete search history.

(56) References Cited

U.S. PATENT DOCUMENTS 232,028 A * 9/1880 Harrington ..... F42B 33/04 86/37
2,685,252 A * 8/1954 Catlin ..... F42C 19/10 102/470

(Continued)

FOREIGN PATENT DOCUMENTS

DE 10 2004 020 838 B3 6/2005
DE 10 2011 014 402 A1 9/2012
EP 2 023 031 A1 2/2009

*Primary Examiner* — Derrick R Morgan
(74) *Attorney, Agent, or Firm* — Muncy, Geissler, Olds & Lowe, P.C.

(57) ABSTRACT

A cartridge with a drive system and a projectile which is connected to the drive system, wherein the drive system has a propellant case filled with a propellant and has a case bottom containing a substantially axially extending case bottom opening with a T-shaped edge contour. The case bottom opening is closed by a plug which is of T-shaped configuration, receives an ignition cap and is held in position by a safety fuse ring of a rupture disc. The safety fuse ring is arranged between the front side of the head part of the plug and the rear side of an adjoining inner-side projection of the case bottom, with the result that the propellant chamber is delimited by the front surface of the plug neck. An inner edge of the safety fuse ring engages in a positively locking and/or non-positive manner into an outer groove-shaped recess of the plug.

7 Claims, 1 Drawing Sheet

(51) Int. Cl.
*F42B 5/02* (2006.01)
*F42C 19/08* (2006.01)

(56) References Cited

U.S. PATENT DOCUMENTS 3,138,055 A * 6/1964 Weston ..... F42B 33/04 86/36
4,733,872 A * 3/1988 Sugimura ..... F15B 1/083 138/178
4,836,078 A * 6/1989 Lee ..... F42B 33/005 86/23
5,035,181 A * 7/1991 Jacks ..... F42B 39/20 102/293
5,398,498 A * 3/1995 Mort ..... F02K 9/38 60/223
5,732,634 A * 3/1998 Flickinger ..... F42B 3/125 102/202.14
5,772,976 A * 6/1998 Cortellucci ..... A62B 21/00 423/579
5,957,508 A * 9/1999 Rief ..... F16L 41/10 277/609
6,260,463 B1 * 7/2001 Brand ..... F42B 33/04 86/24
6,752,085 B2 * 6/2004 Roach ..... F42B 39/14 102/481
7,107,909 B2 9/2006 Haeselich
7,806,034 B1 * 10/2010 Lee ..... F42B 33/001 86/37
8,550,004 B1 * 10/2013 Woo ..... F42B 39/20 102/430
8,925,463 B1 * 1/2015 Sullivan ..... F42B 39/20 102/439
8,997,774 B2 * 4/2015 Kotefski ..... B65D 90/32 137/72
2003/0205161 A1 * 11/2003 Roach ..... F42B 39/14 102/481
2007/0151473 A1 * 7/2007 Brunn ..... F42B 5/02 102/444
2012/0204750 A1 * 8/2012 Sullivan ..... F42B 39/20 102/430
2012/0255456 A1 * 10/2012 Fink ..... F42B 39/14 102/481
2013/0291754 A1 * 11/2013 Kotefski ..... B65D 90/32 102/481
2015/0000546 A1 * 1/2015 Kotefski ..... B65D 90/36 102/481
2015/0075400 A1 * 3/2015 Lemke ..... F42B 5/307 102/517

* cited by examiner

CARTRIDGE WITH SAFETY FUSE IN THE DRIVE SYSTEM, AND METHOD FOR PRODUCING IT

This nonprovisional application is a continuation of International Application No. PCT/EP2015/058616, which was filed on Apr. 21, 2015, and which claims priority to German Patent Application No. 10 2014 005 997.9, which was filed in Germany on Apr. 28, 2014, and which are both herein incorporated by reference.

BACKGROUND OF THE INVENTION

Field of the Invention

The invention relates to a cartridge with a propulsion system and a projectile connected to the propulsion system. The propulsion system comprises a propellant casing that is filled with propellant and has a case bottom that has a substantially axially extending case bottom opening with a T-shaped edge contour. The case bottom opening is closed by a T-shaped plug that accommodates a primer and is held in this position by a fusible ring of a burst protection device in the case bottom opening.

Description of the Background Art

Cartridges of this type are known from DE 10 2011 014 402 A1, for example. In this document, they are preferably cartridges whose projectile caliber is in the medium caliber range, preferably between 35 mm and 40 mm.

A cartridge munition is known from DE 10 2004 020 838 B3, which corresponds to U.S. Pat. No. 7,107,909, which provides relief passages between a propellant chamber and the outside of the cartridge casing, wherein the relief passages are filled with a material that is capable of being melted. The fusible material has a lower melting point than the ignition temperature of the ignition device and the propellant charge. If the ambient temperature of the cartridge casing rises above the melting point of the fusible material, the material melts and opens the relief passages so that when the propellant charge subsequently ignites, it burns away without pressure buildup.

US 2012/0204750 A1 describes a pressure relief system for a cartridge, and US 2003/0205161 describes a method and device for releasably fastening a closure plate to a casing.

Cartridges of this type each contain a burst protection device in order to prevent them from exploding in the event of a fire, such as at a munitions depot. The burst protection device consists essentially of a pressure relief opening formed by the case bottom opening and the fusible ring acting as a safety fuse. In this design, the back of the fusible ring facing the case bottom bears against a projection of the case bottom, and the front of the fusible ring delimits the propellant chamber. The plug containing the primer is inserted into the case bottom opening from the back of the case bottom and is held in the case bottom opening by the fusible ring. To this end, the front end of the plug neck has a widening that engages behind the fusible ring on the propellant side.

The fusible ring is made of a pressure-resistant material whose melting point is lower than the lowest ignition temperature of the pyrotechnic ignition charge of the primer and of the propellant powder, so that in the event of a fire the fusible ring melts first before the primer can ignite, and thus the plug releases its hold and opens the pressure relief opening.

To assemble the cartridge, the fusible ring is inserted into the interior of the propellant casing from its front side facing the projectile of the cartridge. This makes assembly of cartridges more difficult, especially with long propellant casings and relatively small calibers. Moreover, the propellant casing is not filled with the propellant charge until after assembly of the fusible ring, and only after that is the projectile joined to the propellant casing.

The direct contact of the fusible ring with the propellant charge and the high internal ballistic stresses associated therewith can result in damage to the fusible ring, and hence under certain circumstances also gas pressure losses, upon firing of the applicable cartridge.

SUMMARY OF THE INVENTION

It is therefore an object of the invention to provide a cartridge that is simpler to assemble than comparable prior art cartridges, and with which damage to the fusible ring is reliably avoided when the cartridge is fired. In addition, a method for assembling the cartridge is to be disclosed.

The invention is based substantially on the idea of arranging the fusible ring not at the propellant-side end of the plug neck in the propellant casing, but instead between the front of the head part of the plug and the back of an adjacent internal projection of the case bottom, so that the propellant chamber is delimited not by the fusible ring but only by the front surface of the plug neck. Moreover, the plastically deformable fusible ring has an outside diameter that is chosen such that it can be placed in the case bottom opening from the outside of the case bottom for assembly.

In the assembled position of the cartridge, the fusible ring is plastically deformed by the axial force exerted on it by the head part of the plug in such a manner that its inner edge engages an outer groove-shaped recess of the plug in a positive and/or frictional manner and its outer edge engages an inner groove-shaped recess of the case bottom in a positive and/or frictional manner.

Assembly of the fusible ring from the back of the case bottom permits reliable, fast assembly regardless of the length of the propellant casing and the caliber of the cartridge. Moreover, assembly no longer takes place from the inside, but from the outside. Furthermore, in only a single process step, the plug with the ring is pressed into the case and the ring is swaged axially so that it expands radially and anchors itself in the propellant casing and the plug.

Because the fusible ring is no longer directly subjected to the gas pressure, the high, persistent gas pressure is prevented from damaging the fusible ring and causing gas pressure losses, even in ammunition types in which very high internal ballistic stresses arise during firing.

Pressing the fusible ring into the groove-shaped recesses of the plug and case bottom seals the plug and case bottom to one another so that no additional seals are required.

Moreover, the method according to the invention permits filling of the propellant casing through the case bottom opening. This allows for the possibility to preassemble the cartridges to the point that only filling with propellant powder and sealing of the case bottom opening are required.

Further details and advantages of the invention are evident from the following exemplary embodiment, described with the aid of figures. The figures show:

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
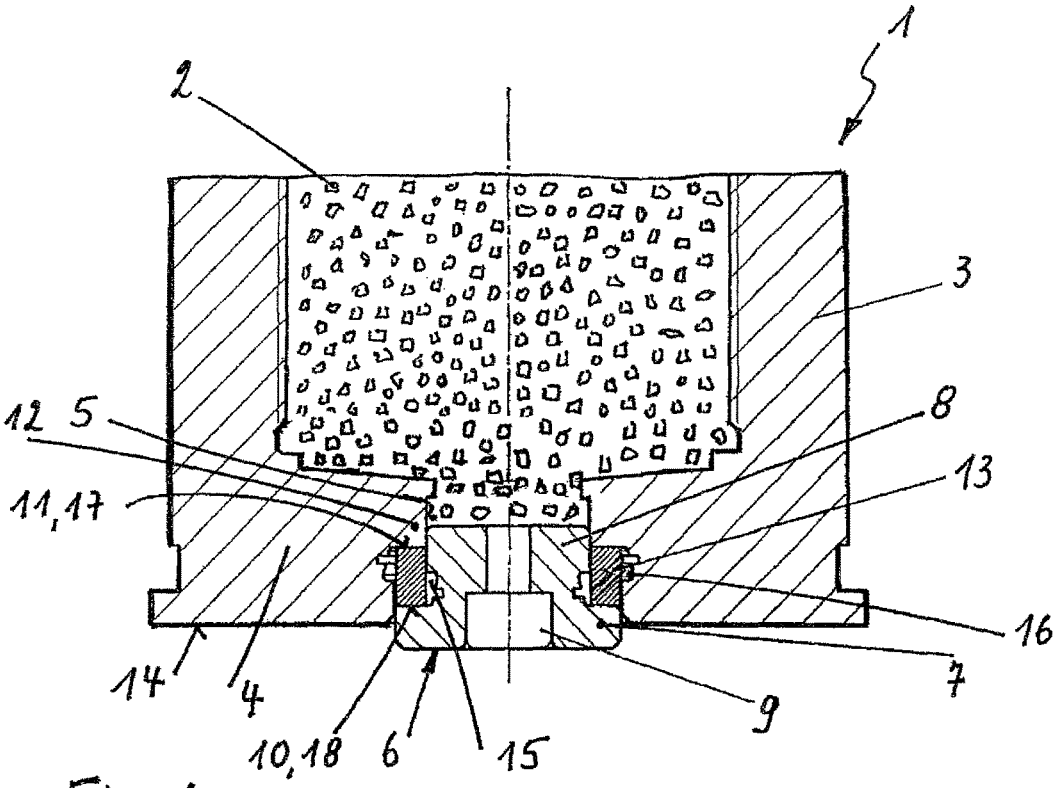
FIG. 1 illustrates a longitudinal section through the rear area of the propulsion system of a cartridge according to the invention after insertion of a fusible ring and a plug into the case bottom opening of the propellant casing, before the plug is in its assembled final position.
Figure 2:
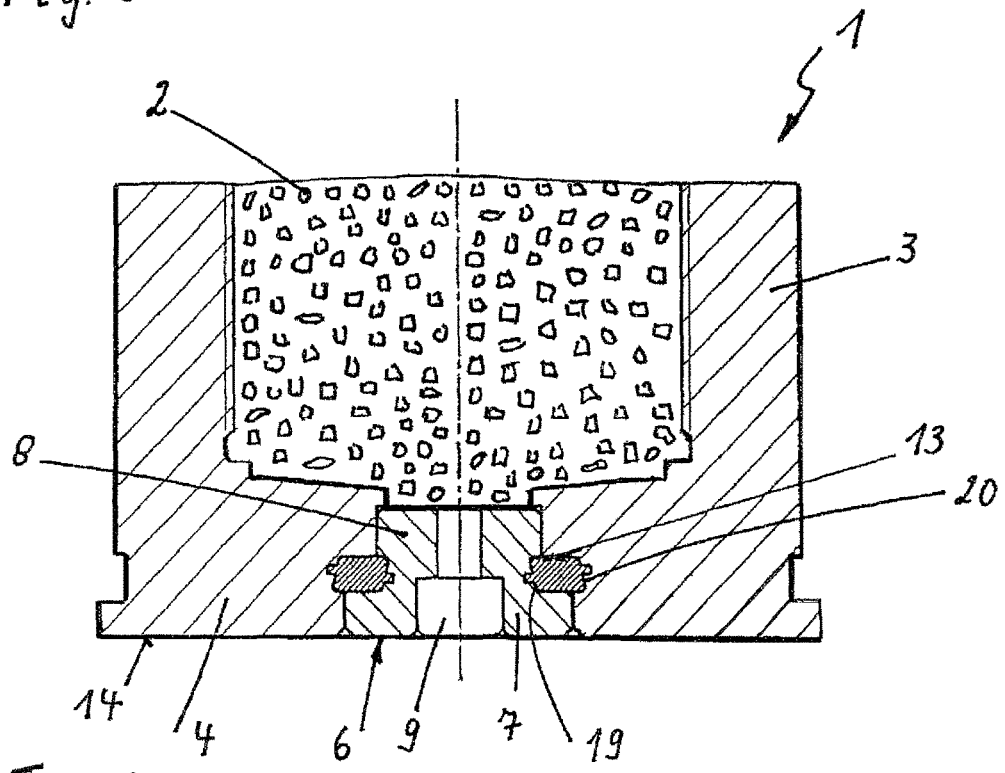
FIG. 2 illustrates a view corresponding to FIG. 1 after the plug has reached its final position.

In FIGS. 1 and 2, the propulsion system of a cartridge according to the invention (for example, a practice cartridge of 40 mm caliber) is labeled 1. For the purpose of a complete insensitive munition (IM), reference is made to DE 10 2004 020 838 B3 or DE 10 2011 014 402 A1, which are incorporated herewith by reference.

The propulsion system 1 comprises a propellant casing 3 filled with a propellant charge 2 and having a case bottom 4 arranged at the back. The case bottom 4 has a case bottom opening 5 with a (preferably) T-shaped edge contour viewed in the direction of the longitudinal axis of the cartridge. The case bottom opening 5 is closed by a corresponding plug 6 that here is T-shaped in design with a head part 7 and a plug neck 8. A primer 9 is pressed into this plug 6.

Arranged between the front 10 of the head part 7 of the plug 6 and the back 11 of an internal projection 12 of the case bottom 4 is a plastically deformable fusible ring 13 (made from an alloy of bismuth and tin, for example) that has an outside diameter chosen such that it can be inserted into the case bottom opening 5 from the back 14 of the case bottom 4 (FIG. 1).

Starting from the position of the plug 6 shown in FIG. 1, if the head part 7 is now subjected to an axial force in the direction of the fusible ring 13, the front 17 of the fusible ring 13 bears against the back 11 of the internal projection 12, and the back 18 of the fusible ring 13 bears against the front 10 of the head part 7 of the plug 6, so that the fusible ring 13 is compressed and plastically deformed. As a result, the material of the fusible ring 13 flows radially into a groove-shaped recess 15 of the plug 6 and into a groove-shaped recess 16 of the fusible ring 13 [sic: should probably read: "case bottom 4"] (FIG. 2). Consequently, the inner edge 19 of the fusible ring 13 now engages the outer groove-shaped recess 15 of the plug (6) in a positive and frictional manner, and the outer edge 20 of the fusible ring engages the inner groove-shaped recess 16 of the case bottom 4 in a positive and frictional manner.

As a result, the plug 6 is fixed in place within the case bottom opening 5 without appreciable impingement on the fusible ring 13 by the propellant gases occurring in the event of later firing.

In contrast, if the cartridge should be exposed to an unintentional fire, for example in a munitions depot, the fusible ring 13 melts before ignition of the primer 9 or the propellant powder takes place, and the plug 6 is released, so that after ignition of the propellant charge 2 the propellant gases that form push it out of the case bottom opening 5 without appreciable velocity.

Assembly of the propulsion system 1 itself is simplified. The primer 9 is placed in the plug 6. The fusible ring 13 is placed in the propellant casing 3. The unit comprising the plug 6 and primer 9 is then pressed into the propellant casing 3 with axial force. In consequence, as already mentioned, the fusible ring 13 is compressed in height so that the material deforms plastically and flows radially into the groove-shaped recesses 15 in the propellant casing 3 and plug 6. This pressing also provides sealing against external environmental influences. The deformation of the fusible ring 13 creates a secure retaining force against the forces arising during transport, vibration, and firing.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for assembling a cartridge having a propulsion system and having a projectile connected to the propulsion system, wherein the propulsion system comprises a propellant casing that is filled with propellant charge and has a case bottom that has a substantially axially extending case bottom opening, and wherein the case bottom opening is closed by a plug that accommodates a primer and the plug is held in position by a fusible ring of a burst protection device, the method comprising:

inserting the fusible ring into the case bottom opening from a rear side of the case bottom of the propellant casing until a front of the ring bears against an internal projection of the case bottom, and then inserting the plug into the case bottom opening; and exerting an axial force on a back of the fusible ring by a head part of the plug so that the fusible ring is compressed and plastically deformed and the material of the fusible ring flows radially into the groove-shaped recesses of the plug and the case bottom, as a result of which no additional seals are necessary.

2. The method according to claim 1, wherein the primer is joined to the plug before the plug is inserted into the case bottom opening of the propellant casing.

3. The method according to claim 1, wherein a filling of the propellant casing takes place through the case bottom opening.

4. A cartridge assembled according to the method of claim 1, wherein the front of the fusible ring bears against the back of an internal projection of the case bottom and the back of the ring bears against the front of the head part of the plug, wherein the inner edge of the ring engages an outer groove-shaped recess of the plug in a positive or frictional manner and its outer edge engages an inner groove-shaped recess of the case bottom in a positive or frictional manner, so that the fusible ring is not directly subjected to gas pressure and no additional seals are required.

5. The cartridge according to claim 4, wherein the fusible ring has an outside diameter chosen such that it is insertable into the case bottom opening from the back of the case bottom for assembly of the cartridge.

6. The cartridge according to claim 4, wherein the plug is T-shaped in design.

7. The cartridge according to claim 4, wherein the plastically deformable fusible ring material is an alloy made of bismuth and tin.

* * * * *